US008167731B2

(12) United States Patent
Brown

(10) Patent No.: US 8,167,731 B2
(45) Date of Patent: May 1, 2012

(54) ARTIFICIAL SKI SLOPE ASSEMBLY

(76) Inventor: Edward Brown, Renfrew (GB)

( * ) Notice: Subject to any disclaimer, the term of this patent is extended or adjusted under 35 U.S.C. 154(b) by 127 days.

(21) Appl. No.: 12/594,557

(22) PCT Filed: Mar. 28, 2008

(86) PCT No.: PCT/GB2008/050226

§ 371 (c)(1),
(2), (4) Date: Mar. 25, 2010

(87) PCT Pub. No.: WO2008/122821

PCT Pub. Date: Oct. 16, 2008

(65) Prior Publication Data

US 2010/0197416 A1 Aug. 5, 2010

(30) Foreign Application Priority Data

Apr. 5, 2007 (GB) ..... 0706698.8

(51) Int. Cl.
*A63C 19/10* (2006.01)
*A63G 1/00* (2006.01)

(52) U.S. Cl. ..... 472/90; 472/3

(58) Field of Classification Search ..... 472/3, 88–94; 182/18, 48

See application file for complete search history.

(56) References Cited

U.S. PATENT DOCUMENTS 4,423,864 A * 1/1984 Wiik ..... 472/91
6,443,259 B1 * 9/2002 Oney et al. ..... 182/48

* cited by examiner

*Primary Examiner* — Kien Nguyen
(74) *Attorney, Agent, or Firm* — Hultquist, PLLC; David S. Bradin; Steven J. Hultquist

(57) ABSTRACT

The present invention relates to a collapsible artificial ski slope assembly (10) and, in particular, but not exclusively, to a collapsible artificial ski slope assembly which can be moved between deployed and storage positions.

14 Claims, 4 Drawing Sheets

ARTIFICIAL SKI SLOPE ASSEMBLY

CROSS-REFERENCE TO RELATED APPLICATIONS

This application is a U.S. national phase under the provisions of 35 U.S.C. §371 of International Application No. PCT/GB08/50226 filed Mar. 28, 2008, which in turn claims priority of U.K. Patent Application No. 0706698.8 filed Apr. 5, 2007. The disclosures of such international application and U.K. priority application are hereby incorporated herein by reference in their respective entireties, for all purposes.

FIELD OF THE INVENTION

The present invention relates to a collapsible artificial ski slope assembly and, in particular, but not exclusively, to a collapsible artificial ski slope assembly which can be moved between deployed and storage positions.

BACKGROUND OF THE INVENTION

Alpine and Nordic sports, such as skiing and snowboarding, are popular activities that are enjoyed by many people around the world. Conventionally, these activities are performed on ski slopes and people will often travel significant distances to find such slopes, for example, to practice skills, to compete, or to simply be able to try out the activity and enjoy the experience.

Such sports are prevalent in mountainous geographical regions having natural snow-covered slopes. However, during certain periods of the year snow may disappear from the slopes at a given location. Thus, it may be necessary to travel elsewhere during these periods to find a snow-covered ski slope. However, traveling to seek snow covered slopes can be expensive and may not be a realistic option for many people.

As an alternative, found particularly in countries that do not have natural snow-covered slopes, there are provided man-made ski slope facilities, such as "dry" or artificial ski slopes that can be visited more readily and that are operational and usable throughout the year.

However, there are drawbacks associated with artificial ski slopes in that they may not be provided in a convenient location and as a result people may not have the time to visit or may be put off visiting altogether. Further, it can be costly to travel and visit an artificial ski slope. In addition, trips to an artificial ski slope, even when located nearby, can be difficult where it is necessary to organise a party of people, for example, when arranging for school children to visit the ski slope on a school excursion.

Thus, many people may miss out on opportunities of experiencing skiing and other similar sports and there exists a need for people to be able to experience such activities more readily.

Currently temporary artificial ski slopes are known that can be constructed in situ by assembling a scaffolding support frame at a desired location and providing a ski slope surface on the scaffolding support frame. However, these structures suffer significant drawbacks. In particular, the scaffolding needs to be assembled on site which is relatively time consuming. Upon moving to a new site the scaffolding must be disassembled, collected and transported to the new site where the scaffolding must then be offloaded and re-assembled. This process can be time consuming and cumbersome. Further, it may typically require a number of workers to construct and later dismantle the structure. Overall, providing such temporary structures can be inefficient and costly and they are not readily provided in convenient locations.

It is amongst the objects of the present invention to obviate or at least mitigate drawbacks and deficiencies associated with existing artificial ski slopes.

SUMMARY OF THE INVENTION

Accordingly, there is provided a collapsible artificial ski slope assembly comprising:

a base unit adapted to be coupled to a vehicle; and at least one ski slope section coupled to the base unit;

wherein the ski slope section is movable with respect to the base unit between: a first deployed position in which the ski slope section defines at least part of a ski slope of the assembly; and, a second storage position in which the ski slope section is stored for transport of the ski slope assembly.

Thus, the ski slope section, being coupled to the base unit and being movable with respect to the base unit, allows the ski slope assembly to be readily moved from/to a position where it may be stored for transport to/from a position where it may function as at least part of a ski slope. This allows the ski slope assembly to be quickly and conveniently deployed for use, collapsed and transported to another location.

The ski slope may be in an unfolded use configuration in the first deployed position and may be in a folded, transport configuration in the second storage position. Thus, the ski slope section can be stored compactly in the folded configuration, while in the unfolded configuration, the ski slope section extends from the base section to a position where it defines a maximised distance or height between a bottom end of the base unit and a top end of the ski-slope section.

Preferably, the ski slope assembly comprises multiple ski slope sections. The multiple ski slope sections may together form the ski slope. The ski slope assembly may comprise first and second ski slope sections which, may together, define or form part of the ski slope. This allows a large ski slope area to be formed from sections that are suitable for transport.

The ski slope assembly may comprise first and second ski slope sections each coupled to the base unit. The first and second ski slope sections may be pivotally coupled to the base unit. Alternatively, the first and second ski slope sections may be coupled to each other and may be movable, with respect to each other, between first and second positions, which may correspond to the deployed and storage positions of the ski slope assembly. The first and second ski slope sections, and/or the base unit, may be in an unfolded use configuration in the deployed position, and may be in a folded transport configuration in the storage position. The first ski slope section may be pivotable or rotatable with respect to the base unit, or the second ski slope section, via a hinge arrangement and/or other coupling arrangement. Thus, the first and second ski slope sections and the base unit may be folded to improve collapsibility and compactness of the ski slope assembly when arranged to be stored for transport.

The ski slope sections may each comprise a slope surface adapted to form part of the ski slope for skiing, snow boarding, sledging and/or other similar "winter sport", alpine and/or Nordic sporting activities. Alternatively, or in addition, the base unit may comprise a slope surface adapted to form part of the ski slope. The slope surfaces may together form the ski slope. The slope surfaces may be arranged/juxtaposed in use to provide a smooth and/or "seamless" surface transition between adjacent slope surfaces. In this way, a smooth and extensive ski surface is provided by providing multiple sections and piecing sections together.

The first and second ski slope sections, and/or the base unit, may together define a ski slope in the first, deployed and/or unfolded position of the ski slope assembly.

The ski slope and/or slope surfaces may be adapted to define areas having different angles of incline. The ski slope and/or slope surfaces may comprise jumps, rails and/or other surface undulations.

Preferably the ski slope assembly comprises at least one platform section, which may be coupled to the ski slope section and/or base unit. The platform section may be adapted to be pivotally coupled to the base unit and/or the ski slope section. The platform section may be deployed adjacent to the ski slope section, for example, near a top end of the ski slope, in use. The platform section may comprise a platform surface, the platform surface adapted to be oriented substantially horizontally when the ski slope is in the first position. Thus, the platform section provides an area that skiers may stand on to get themselves ready before descending the ski slope.

Preferably the ski slope assembly comprises a ramp section coupled to the ski slope section and/or base unit. The ramp section may be inclined when the ski slope assembly is in the first, deployed position, and may comprise a ramp surface, which may assist skiers or snowboarders to perform jumps and/or tricks. The ramp section may be adapted to be coupled to the base unit and/or the ski slope section. The ramp section may form part of the ski slope when the ski slope assembly is in the deployed position and/or the unfolded use configuration. Preferably the ramp section is adapted to be positioned near a bottom end of the ski slope. Thus, skiers can build up speed by descending the ski slope before reaching the ramp surface. The ski slope assembly may be positioned in different orientations such as lengthways or sideways. By positioning the ski slope lengthways provides a longer run but up to a maximum angle of greater 35°. By positioning the ski slope sideways provides a shorter run but up to a maximum angle of about 35°.

Preferably the ski slope assembly comprises security means adapted to protect a skier and/or snowboarder from injury, for example, by accidentally falling from an edge of the ski slope. The security means may comprise a safety barrier and/or safety netting. The safety barrier may comprise cushioning means, which may comprise air inflatable cushions. The security means may be foldably coupled to the base unit and/or a ski section, e.g. for facilitating foldable and compact collapse of the ski slope.

The base unit may be attached and/or mounted to a vehicle. The base unit may be adapted to support the ski slope section, and/or, in specific embodiments, to support the platform and/or ramp sections. Alternatively, or in addition, the base unit is integral to the vehicle. The vehicle may be a lorry/truck or other heavy goods vehicle adapted to accommodation the ski slope section(s) and to transport the ski slope assembly. By being attached to the vehicle the ski slope assembly can be driven to a site as required, and be immediately ready for unfolding of the ski slope section. The base unit may also be lifted up at an angle which may be used to provide extra height for the slope. This may be variable from about 15° to 35°.

The base unit may be releasably attached to the vehicle. This provides an option of allowing the vehicle to move out of the way of the ski slope assembly once it has been moved to the required location for deployment.

The ski slope assembly may be adapted to provide storage for equipment such as skis, boards, sledges, boots and/or other items. More specifically, the ski slope may comprise at least one storage compartment/hold/facility for such items. The base unit may comprise the storage compartment/hold/facility.

The ski slope assembly may comprise an actuation mechanism, which may be a hydraulic mechanism, adapted to actuate folding/foldable movement of ski slope, platform, or ramp sections and/or safety barriers. The actuation mechanism may also be adapted to actuate to form jumps or rails that protrude from a ski surface.

The ski slope assembly may also comprise a lighting system and/or an audio system which may be powered by a generator. In addition, the ski slope assembly may comprise a tow-bar system to pull users from a bottom end of the ski slope to a top end of the slope. The tow-bar system may also be powered by the generator.

There may also be a camera located at the bottom of the ski slope which may be used to take photographs.

The system may also comprise inflatable side bars which provides weight saving and facilitates installation.

The ski slope assembly may also be constructed from an inflatable device such as commonly known as a 'bouncy castle'.

BRIEF DESCRIPTION OF THE DRAWINGS

There will now be described, by way of example only, embodiments of the invention, with reference to the accompanying drawings, in which.

DETAILED DESCRIPTION

Figure 1A:
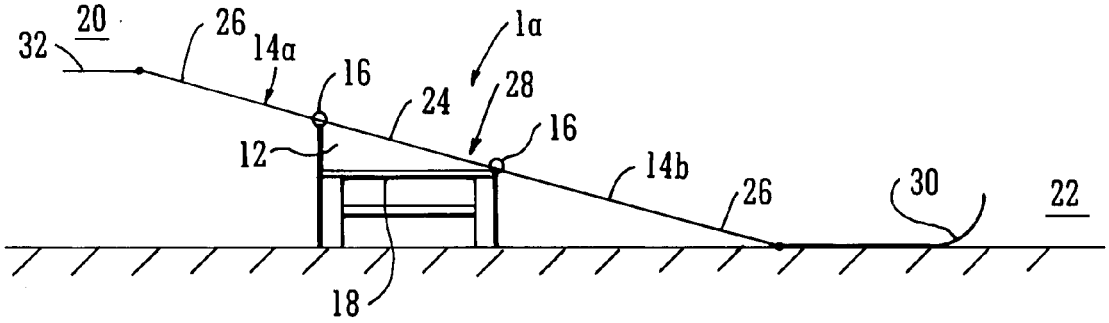
FIG. 1A is a cross-sectional line drawing of an artificial ski slope in a deployed position, according to an embodiment of the invention.
Figure 1B:
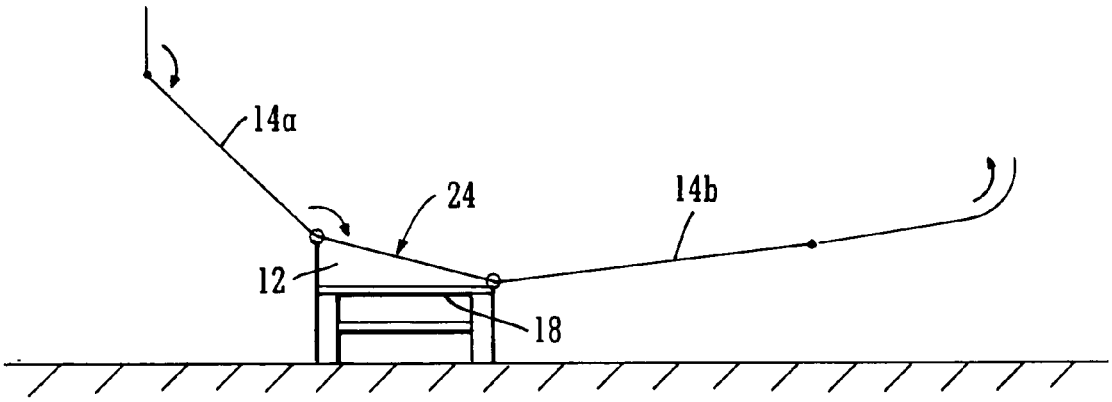
FIG. 1B is a cross-sectional line drawing of the artificial ski slope of FIG. 1A in a partially deployed position.
Figure 1C:
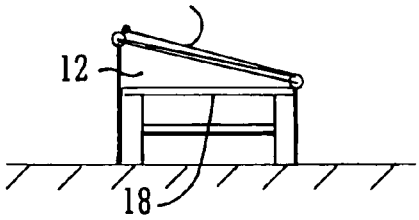
FIG. 1C is a cross-sectional line drawing of the artificial ski slope of FIGS. 1A and 1B in a storage position.

With reference firstly to FIGS. 1A to 1C there is generally shown a collapsible artificial ski slope assembly 10 at different stages during its deployment. In FIG. 1A, the ski slope assembly 10 is shown in a deployed position, while FIG. 1B shows the ski slope assembly during movement to a stored position illustrated in FIG. 1C.

The ski slope assembly 10 includes a base unit 12 and ski slope sections 14*a, b*, which are coupled to the base unit 12, in this case by means of heavy-duty hinge mechanisms 16. The ski slope sections 14*a, b*, are allowed to move with respect to the base unit 12 and fold inwardly around hinge axes, as indicated by the arrows in FIG. 1B, into a compact storage configuration as shown in FIG. 1C. In this embodiment, the base unit 12 is attached to the back of a lorry trailer 18, allowing the lorry to readily transport the ski slope in its storage position, to another location according to requirements. However, the base unit 12 may be provided on a flat-bed of a lorry (not shown).

In the deployed position of FIG. 1A, the ski slope sections 14*a, b*, are unfolded from the base unit 12 and form a ski slope 10 extending from a top end 20 to a bottom end 22. The base unit 12 itself has an inclined slope surface 24, with the ski slope sections 14*a, b*, abutting and being coupled to the base unit 12 at its upper and lower ends. The inclined slope surface 24 of the base unit 12, together with slope surfaces 26 of the ski slope sections 14*a, b*, define a ski surface or area 28 suitable for skiing, snowboarding or carrying out other activities, which is practically continuous across sections, such that joins between sections are not noticeable to users during normal use.

At the bottom end 22 of the slope, the ski surface terminates with an inclined ramp section 30 for users to practice their tricks and jumps. A horizontal start platform 32 is provided at the top end of the slope to conveniently allow users to gather and wait at the top and to prepare themselves, if required, before descending the slope. The platform 32 and ramp 30 are provided as separate sections and are respectively coupled to the top and bottom ends of upper and lower ski slope sections 14, via the hinge mechanisms 16, to allow the sections to foldably move with respect to the adjacent ski slope sections 14*a, b*, and the base unit 12 for storage.

The lorry trailer 18 and base unit 12 support the ski slope sections 14*a, b*, from beneath. The ramp sections 30 rests on the ground, and further provides both lateral and vertical support for the ski slope sections 14*a, b*, and the platform, section 32. Further support for the ski slope sections 14*a, b*, is provided by a suitable support arm (not shown). In an alternative embodiment, support for the various sections may be at least partly provided by the hinge mechanisms 16, for example, by hinges including a stop member, (not shown), that limits their range of motion and prevents unfolding of the sections about the hinges, beyond a predetermined "deployed" position.

In order to store and transport the ski slope 10, the different sections are folded inwardly, as shown in FIG. 1B, around the hinges 16 and with respect to the base unit 12. In the stored position of FIG. 1C, the ski slope sections 14*a, b*, rest compactly against each other on top of the base unit. In this position, the sections remain coupled to each other to enable the sections to be quickly and conveniently unfolded and deployed to form a ski slope again later.

In FIGS. 2A to 2E, there is shown another embodiment of a collapsible artificial ski slope assembly 210. This ski slope assembly 210 has a number of features that are similar to the ski slope assembly 10 described above, with reference to FIGS. 1A to 1C, and like components are annotated with the same reference numerals, incremented by two hundred.

In this embodiment, an upper ski slope section 214*a* is formed with both a slope surface 226*a* and a platform surface 246. A ski surface 228 is made up from a platform surface 246, the slope surface 226*a*, a slope surface 224 of the base unit 212, a surface 226*b* of a lower ski slope section 214*b* and a ramp surface 248 of the terminating ramp section 230. The sections 214*a, b*, 230, and the base unit 212 are provided with safety barriers 244, including inflatable or padded cushions, (not shown), that enclose the ski surface area 228. These barriers 244 act to cushion skiers in the event that they lose control and crash into the sides of the slope assembly 210, and to prevent skiers from accidentally falling off the edges of the ski slope assembly 210. In the deployed position, the upper ski slope section 226*a* is supported by a support member 250, which is pivotally coupled to the base of the section 226*a*.

Figure 2A:
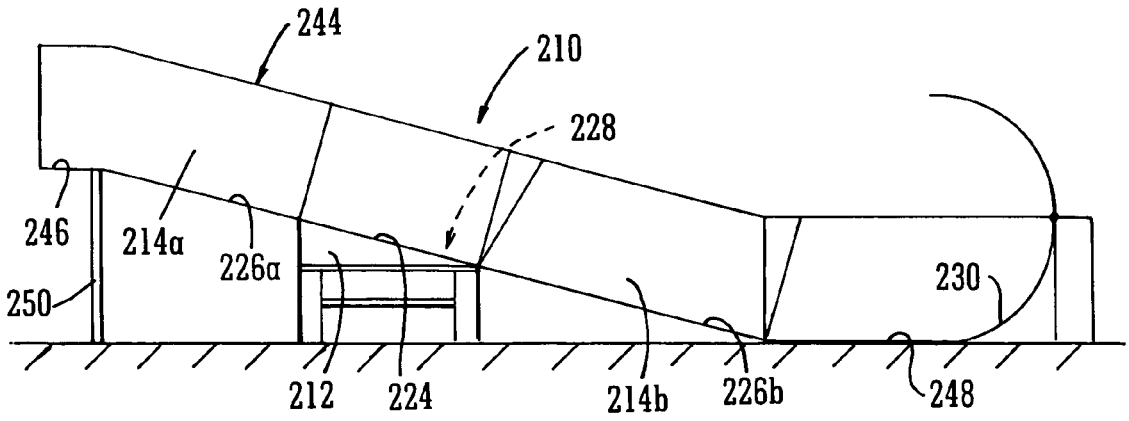
FIGS. 2A to 2E are cross-sectional representations of a collapsible artificial ski slope at progressively more advanced stages of folding, according to another embodiment of the invention.

In FIG. 2A, the collapsible ski slope 210 is shown in an unfolded configuration. Folding of the slope 210 to prepare it for transport is initiated and driven by a hydraulic actuating mechanism (not shown). In this way, the slope is collapsed from an initial configuration as shown in FIG. 2A, to a compact folded storage configuration, as will now be described with reference to FIGS. 2B to 2E.

Figure 2B:
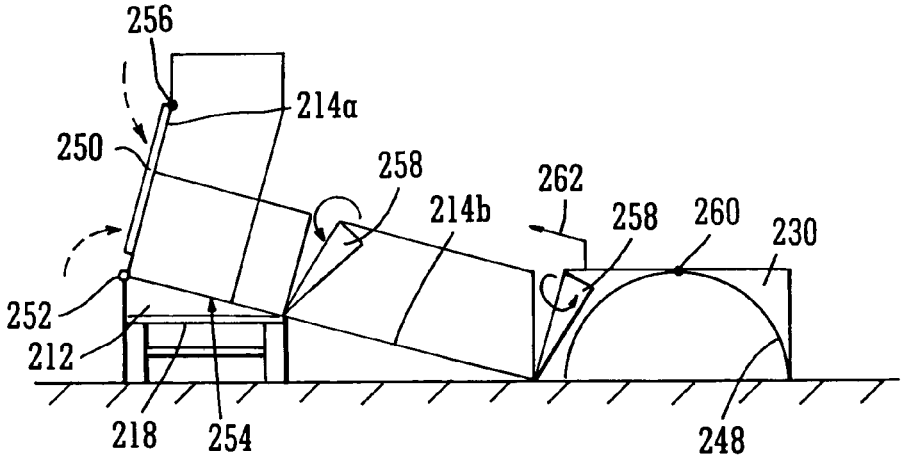

The upper slope section 214*a* is first folded about the axis 252 until a leading edge 254 comes into abutment with the base unit 212, as depicted in FIG. 2B. In addition, the support member 250 is folded, as indicated, about an axis 256 along which it is coupled to the upper slope section 214*a*, such that it locates parallel to the base of the upper slope section 214*a*. At this stage, triangular barrier portions 258 of the lower slope section 214*a*, and the ramp section 230, are folded back on themselves to free up space and to allow the sections 214*b* and 230 to be folded and arranged compactly on the trailer 218.

Figure 2C:
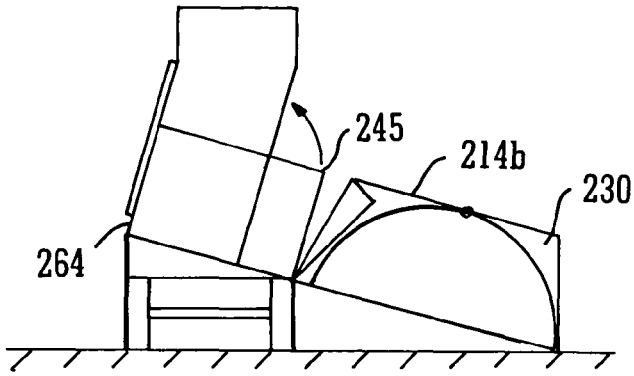

The ramp surface 240 of the ramp sections 230 is then rotated about pivot 260 and upturned for storage and a motor driven mechanism, (not shown), forming part of the ski slope 210, is engaged to urge and move the ramp sections 230 relative to the lower ski slope section 214*b*, (as indicated by arrow 262), so that the sections overlap each other, as shown in FIG. 2C, ready for storage.

Figure 2D:
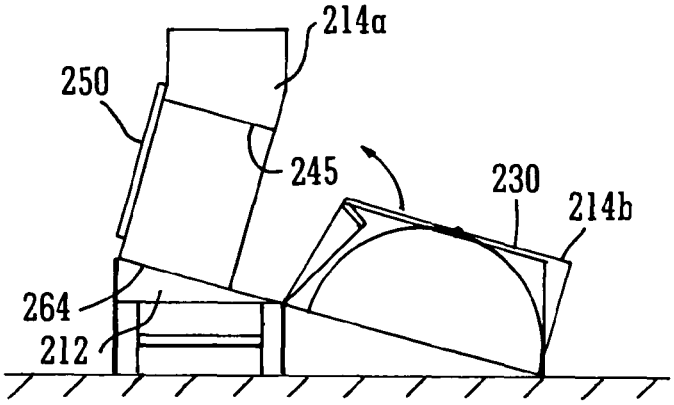
Figure 2E:
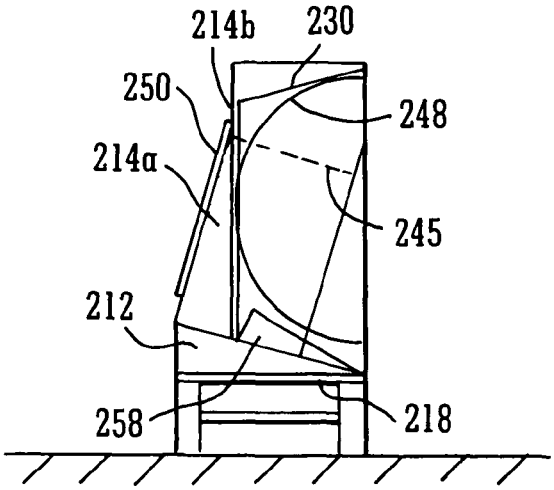

Next, barrier sections 245 of the base unit 212 are rotated into the position of FIG. 2D with their leading edge 264 resting against the base unit 212. Finally, the overlapping ramp and lower ski slope sections 230, 214*b* are folded inwardly, as indicated by the arrow in FIG. 2D, into the storage position of FIG. 2E (presented on the same page FIG. 2A), for transport.

Figure 3B:
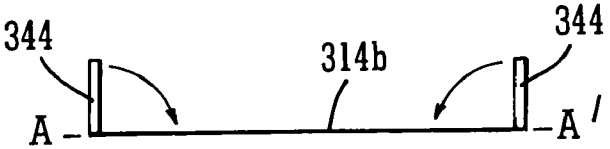
FIG. 3B is a cross-sectional representation (along A-A') of a ski slope section of the artificial ski slope of FIG. 3A.
Figure 3A:
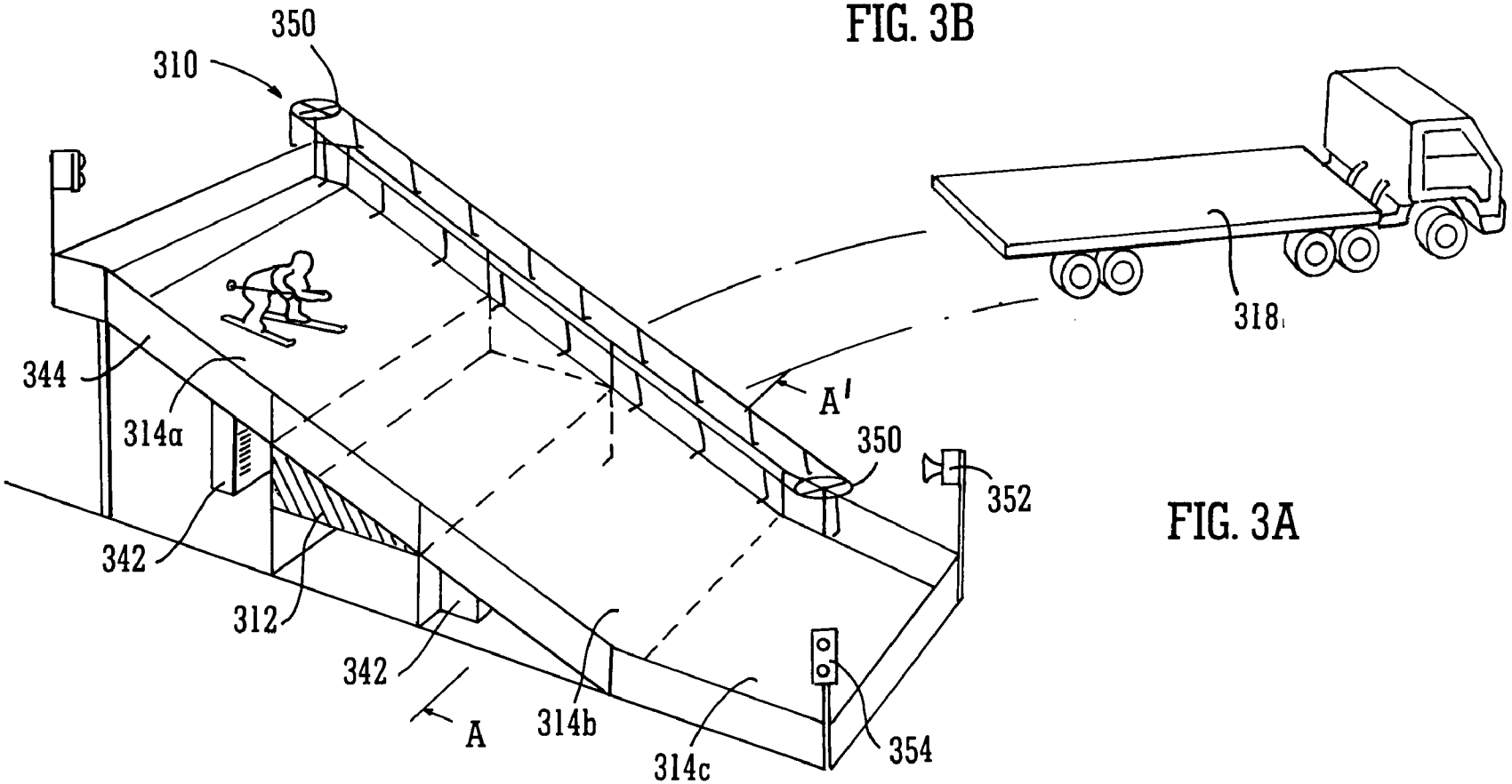
FIG. 3A is a perspective view of an artificial ski slope in a deployed position according to another embodiment of the invention.

In FIGS. 3A and 3B there is shown a further embodiment of a collapsible artificial ski slope 310. This ski slope 310 has a number of features that are similar to those of the ski slope 10, described above. Like components are annotated with the same reference numerals as used in FIGS. 1A to 1C, incremented by three hundred.

In this embodiment, a base unit 312 performs a similar function to that described above, but in this case it is releasably attachable to a lorry trailer 318 so that the base unit 312 can be attached to the trailer to transport the ski slope 310 as required. Thus, the artificial ski slope 310 may be brought to a location where the base unit 312 is detached, to release the ski slope assembly 310 from the trailer, and then the ski slope assembly is left at that location until a later time. As seen in FIG. 3A the base unit 312 is supported from the ground enabling the lorry and trailer 318 to temporarily leave the site until returning at a later time to transport the slope assembly away.

The ski slope assembly 310 is also provided with holds or compartments 342 for storage of ski and snowboarding equipment, which are formed underneath ski slope sections 314*a, b*. Such equipment may include boots, poles, skis, boards and sledges. The compartments 342 facilitate compact storage of equipment and makes available additional storage space on the lorry for sections of the ski slope assembly. Accordingly, the ski slope assembly 310 can have a larger ski surface area when the storage capacity of the lorry is limited, and where the equipment would otherwise need to be stored separately. This storage facility provides for equipment to be readily transported along with the ski slope. In other embodiments, equipment storage facilities may be manufactured into the base unit 312.

The ski slope assembly 310 also includes safety barriers 344. In this embodiment, the barriers are provided in sections that are foldably coupled to the ski slope sections 314 and base unit 312. Thus, the barriers 344 can also fold, as shown more clearly in FIG. 3B, along side edges of the ski slope sections, to facilitate compact folding and collapse of the ski slope to a storage position (not shown). Similar safety or "crash" barriers may also be provided at the top and bottom ends of the platform 132 and the ramp 330, to prevent skiers from accidentally falling off the edges of the ski slope.

Further, in the embodiment of FIGS. 3A and 3B, the ski slope assembly 310 is fitted with a tow bar system for pulling skiers to the top of the slope. The tow bar system is a portable revolving belt system. Also, the ramp is omitted and the slope terminates in a substantially flat run-out ski slope section 314*c*. The slope of FIGS. 3A and 3B can also light up via flood lights 352 that are powered by a generator. Loudspeakers 354 are also provided to play music for entertainment purposes, or to convey messages to users.

Various modifications and changes may be made without departing from the scope of the invention herein described.

Although the above described embodiments refer to the use of hinge mechanisms to provide for coupling between various sections, it will be understood that other arrangements or mechanisms could equally be employed to perform the function of allowing sections to move with respect to each other and/or the base unit between folded and unfolded configurations. Further, it will be understood that other systems could be used to cause folding. For example, mechanical or electrical systems might be used together or instead of the hydraulic mechanism referred to above.

In addition, various in-built jumps or rails may be produced in the ski surface by actuating the jump or rail from a hidden stored position beneath the surface to an operational position where it protrudes from the surface (e.g. using a hydraulic mechanism located underneath the surface).

In other embodiments (not shown), safety netting may be provided to improve safety, in particular, when a ramp is deployed. Further, a sprinkler system may be provided to wet the ski surface.

The present invention has a number of advantages. In particular, as the ski slope has multiple sections that remain coupled and are foldable, it is easy and convenient to deploy the ski slope sections to form a ski slope and to store the ski slope sections for transport after use. It is therefore efficient and cost effective to provide a ski slope in any given location. In turn, it provides access to ski slope facilities for a greater number of people than feasible using the prior art methods and apparatus.

The invention claimed is:

1. A collapsible artificial ski slope assembly comprising:

a base unit adapted to be coupled to a vehicle; and at least one ski slope section coupled to the base unit;

wherein the ski slope section is movable with respect to the base unit between: a first deployed position in which the ski slope section defines at least part of a ski slope of the assembly; and, a second storage position in which the ski slope section is stored for transport of the ski slope assembly, and wherein the ski slope assembly further comprises one or more of a platform, ramp sections and safety barriers, wherein the ski slope assembly comprises an actuation mechanism which is a hydraulic mechanism, adapted to actuate folding/foldable movement of ski slope, platform, or ramp sections and/or safety barriers and wherein the ski slope assembly comprises a lighting system and/or an audio system which is powered by a generator and wherein a camera is located at the bottom of the ski slope and the ski slope assembly also comprises inflatable side bars.

2. A collapsible artificial ski slope assembly according to claim 1, wherein the ski slope section, being coupled to the base unit and being movable with respect to the base unit, allows the ski slope assembly to be readily moved from/to a position where it is storable for transport to/from a position where it is functionable as at least part of a ski slope.

3. A collapsible artificial ski slope assembly according to claim 1, wherein, the ski slope assembly comprises any one of or combination of the following:

multiple ski slope sections which together form the ski slope; and first and second ski slope sections each coupled to the base unit.

4. A collapsible artificial ski slope assembly according to claim 1, further comprising first and second ski slope sections, wherein the first and second ski slope sections are coupled to each other and are movable, with respect to each other, between first and second positions which correspond to the deployed and storage positions of the ski slope assembly, and wherein the first and second ski slope sections, and/or the base unit, are in an unfolded use configuration in the deployed position, and in a folded transport configuration in the storage position.

5. A collapsible artificial ski slope assembly according to claim 4, comprising at least first and second ski slope sections, wherein the first ski slope section is pivotable or rotatable with respect to the base unit, or the second ski slope section, via a hinge arrangement and/or other coupling arrangement.

6. A collapsible artificial ski slope assembly according to claim 1, further comprising one or more ski slope sections, wherein the ski slope sections comprise a slope surface adapted to form part of the ski slope for skiing, snow boarding, sledging and/or similar "winter sport", alpine and/or Nordic sporting activities.

7. A collapsible artificial ski slope assembly according to claim 1, wherein the base unit comprises one or more slope surfaces adapted to form part of the ski slope, and the one or more slope surfaces form the ski slope, and wherein the one or more slope surfaces are arranged/juxtaposed in use to provide a smooth and/or "seamless" surface transition between adjacent slope surfaces.

8. A collapsible artificial ski slope assembly according to claim 1, further comprising first and second ski slope sections, wherein first and second ski slope sections, and/or the base unit, together define a ski slope in the first, deployed and/or unfolded position of the ski slope assembly, and wherein the ski slope and/or slope surfaces are adaptable to define areas having different angles of incline.

9. A collapsible artificial ski slope assembly according to claim 1, wherein the ski slope and/or slope surfaces comprise jumps, rails and/or other surface undulations, and wherein the rails are inflatable.

10. A collapsible artificial ski slope assembly according to claim 1, wherein the ski slope assembly comprises at least one platform section which is coupled to the ski slope section and/or base unit, wherein the platform section is adaptable to be pivotally coupled to the base unit and/or the ski slope section, and wherein the platform section is deployed adjacent to the ski slope section, near a top end of the ski slope, in use, and wherein the platform section comprises a platform surface, the platform surface adapted to be oriented substantially horizontally when the ski slope is in the first position, and wherein the platform section provides an area that skiers may stand on to get themselves ready before descending the ski slope.

11. A collapsible artificial ski slope assembly according to claim 1, wherein the ski slope assembly comprises a ramp section coupled to the ski slope section and/or base unit, wherein the ramp section is inclined when the ski slope assembly is in the first, deployed position, and comprises a ramp surface, which assists skiers or snowboarders to perform jumps and/or tricks, and wherein the ramp section is adapted to be coupled to the base unit and/or the ski slope section, and wherein the ramp section forms part of the ski slope when the ski slope assembly is in the deployed position and/or the unfolded use configuration.

12. A collapsible artificial ski slope assembly according to claim 1, wherein the ski slope assembly comprises security means adapted to protect a skier and/or snowboarder from injury and the security means comprises a safety barrier and/or safety netting.

13. A collapsible artificial ski slope assembly according to claim 1, further comprising one or more platform and/or ramp sections, wherein the base unit is attached and/or mounted to a vehicle and the base unit is adapted to support the ski slope section and/or to support the platform and/or ramp sections.

14. A collapsible artificial ski slope assembly according to claim 1, wherein the base unit is integral to the vehicle and/or the base unit is releasably attached to the vehicle, and wherein the ski slope assembly is adapted to provide storage for equipment such as skis, boards, sledges, boots and/or other items.

* * * * *